United States Patent [19]

Billon et al.

[11] Patent Number: 4,498,974

[45] Date of Patent: Feb. 12, 1985

[54] PROCESS FOR CONVERTING A HIGHLY VISCOUS HYDROCARBON CHARGE TO A LESS VISCOUS, MORE EASILY TRANSPORTABLE AND MORE EASILY REFINABLE HYDROCARBON FRACTION

[75] Inventors: Alain Billon, Orlienas; Jean-Francois Le Page, Rueil-Malmaison; Jean-Pierre Peries, Mornant, all of France

[73] Assignee: Institut Francais du Petrole, Rueil-Malmaison, France

[21] Appl. No.: 532,928

[22] Filed: Sep. 16, 1983

[30] Foreign Application Priority Data

Sep. 17, 1982 [FR] France ..... 82 15839

[51] Int. Cl.[3] ..... C10G 45/58

[52] U.S. Cl. ..... 208/96; 208/309

[58] Field of Search ..... 208/96, 309, 89

[56] References Cited

U.S. PATENT DOCUMENTS

| | | | |
|---|---|---|---|
| 2,696,458 | 12/1954 | Strickland | 208/96 |
| 2,914,457 | 11/1959 | Beavon | 208/96 |
| 2,943,050 | 6/1960 | Beavon | 208/96 |
| 2,947,681 | 8/1960 | Read et al. | 208/309 |
| 3,094,480 | 6/1963 | Richardson | 208/89 |
| 3,532,618 | 10/1970 | Wunderlich et al. | 208/96 |
| 3,775,294 | 11/1973 | Peterson et al. | 208/89 |
| 4,397,734 | 8/1983 | Eilers et al. | 208/96 |

*Primary Examiner*—Delbert E. Gantz
*Assistant Examiner*—Glenn A. Caldarola
*Attorney, Agent, or Firm*—Millen & White

[57] ABSTRACT

Process for reducing the viscosity of a highly viscous hydrocarbon charge containing 10–30% b.w. of constituents distilling above 375° C., said treatment comprising hydrovisbreaking said charge to such an extent as to convert 10 to 30% of the 375° C.+ fraction to a 375° C.− fraction, fractionating the hydrovisbreaked product to separate a fraction comprising at least 90% of the constituents boiling below 375° C. from a distillation residue, deasphalting said distillation residue and admixing at least a portion of the deasphalted distillation residue with at least a portion of said fraction comprising at least 90% of the constituents boiling below 375° C.

9 Claims, 1 Drawing Figure

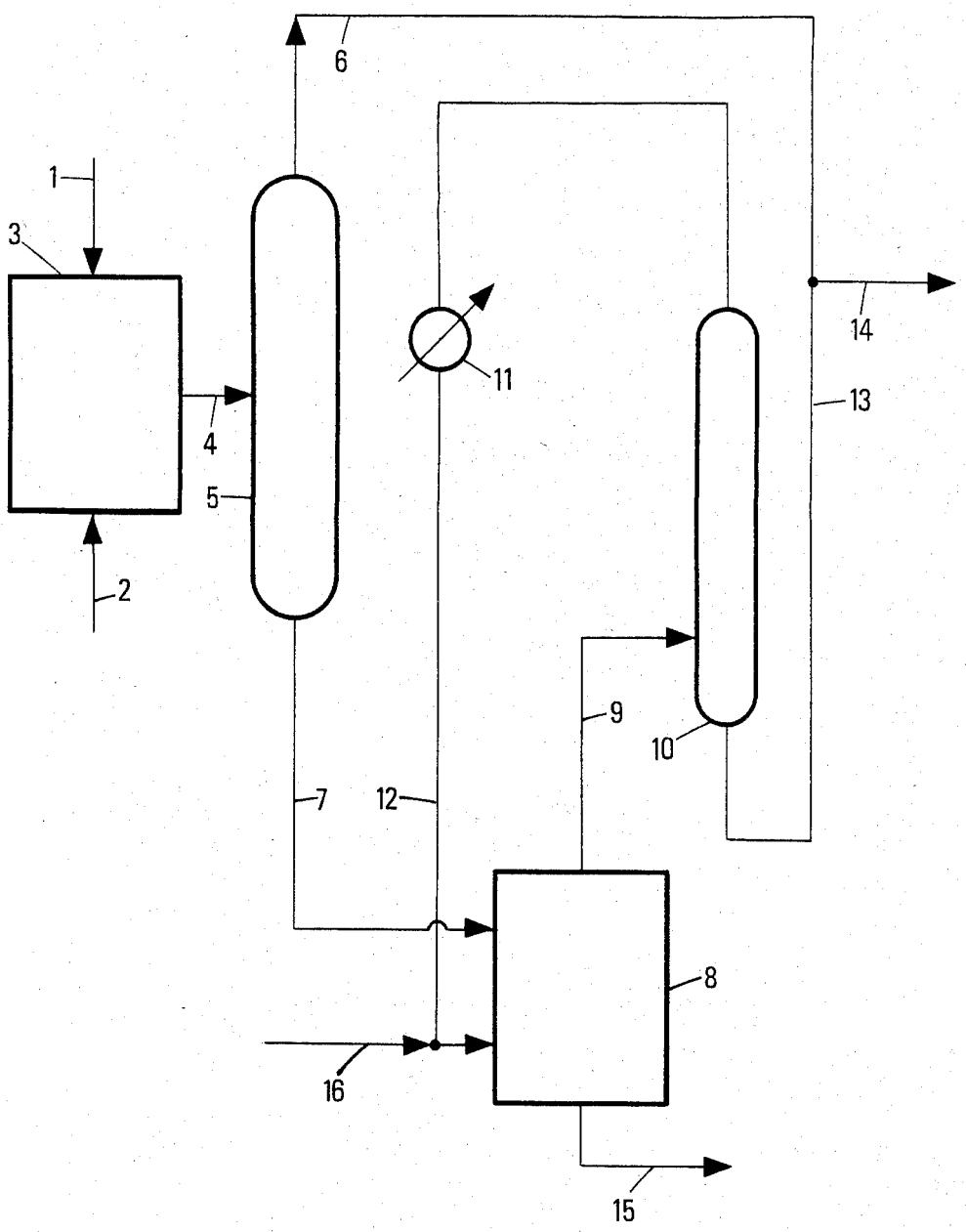
1
2
3
4
5
6
7
8
9
10
11
12
13
14
15
16

PROCESS FOR CONVERTING A HIGHLY VISCOUS HYDROCARBON CHARGE TO A LESS VISCOUS, MORE EASILY TRANSPORTABLE AND MORE EASILY REFINABLE HYDROCARBON FRACTION

BACKGROUND OF THE INVENTION

This invention concerns the treatment of highly viscous hydrocarbon oils of high metals content, in order to convert these oils to a less viscous and consequently more easily transportable hydrocarbon mixture. Simultaneously the conversion according to the invention is such that the obtained hydrocarbon mixture has a reduced content of metals and asphalts and a more favorable distribution of its components. The latter may be subjected more easily to conventional refining treatments.

Numerous techniques for the thermal treatment of highly viscous crude oils have already been proposed in order to obtain an oil which can be transported more easily and converted to valuable products, but the success of these techniques was limited by the specifications that the resultant products must satisfy. In particular the conversion must not be too high in order to avoid the formation of excessive amounts of light hydrocarbons which are more difficult to transport; on the other hand, the quality of the obtained fractions must not be altered but, on the contrary, improved, so as to make them useful, for example, as catalytic refining charges; in this case, the content of such metals as vanadium and nickel must be reduced to the maximum extent, said metals being responsible for the deactivation of the refining catalysts. Moreover, as concerns the obtained heavy fraction, a too high conversion rate is detrimental to its stability (as defined by U.S. Standard ASTM 1661). Finally, the energy cost of the conversion must remain within reasonable limits. Among the techniques proposed up to now, illustrative examples are those described in U.S. Pat. Nos. 3,132,088, 3,193,487, 3,324,028, 3,338,818, and 4,005,006 and in the French Pat. No. 2,489,835.

SUMMARY OF THE INVENTION

The process according to the invention comprises the following steps:

(a) subjecting the hydrocarbon charge, containing 10 to 30% by weight of constituents normally distilling below 375° C., including 8 to 25% by weight of constituents normally distilling between 200° and 350° C., the remaining constituents normally distilling above 375° C., to a hydrovisbreaking such that the conversion by weight of the 375° C.+ fraction to a 375° C.− fraction is from 10 to 30%, preferably from 15 to 25%;

(b) fractionating by distillation the product of step (a) to a distilled fraction containing at least 90% of constituents normally boiling below 375° C. and a distillation residue containing the other constituents, (c) subjecting the distillation residue of step (b) to solvent deasphalting, the solvent being selected from hydrocarbons having 4 to 6 carbon atoms, said solvent preferably containing at least 90% of $C_5$ and/or $C_6$ hydrocarbons, so as to obtain an asphaltic liquid fraction and a deasphalted fraction, and (d) admixing the distilled fraction from step (b) with the deasphalted fraction from step (c), so as to form an easily transportable synthetic crude mixture, of reduced metals content and of a quality corresponding to the usual refining requirements.

BRIEF DESCRIPTION OF THE DRAWING

The FIGURE is a schematic flow diagram of an illustrative embodiment of the process of the invention.

DETAILED DISCUSSION

Examples of charges which can be improved by the process of the invention are crude oils of high asphalt content, of specific gravity ($d_4^{15}$) higher than 0.965, of API degree lower than 15, containing more than 5% by weight of asphaltenes (content determined with n-heptane), of (Ni+V) metals content higher than 200 ppm by weight, and of viscosity greater than 50 cSt (50 mm2/s) at 100° C., as well as residues from said crude oils, shale or bituminous sand oils, asphalts or liquefied coal fractions having the above-mentioned characteristics.

The moderate hydrovisbreaking, as above defined, provides for a maximum decrease of the viscosity of the effluent, while keeping the latter stable; in particular, the distillation residue boiling above 375° C. must be considered as stable when complying with standard ASTM D 1661; beyond the above-mentioned limits of conversion rate this distillation residue does not fulfil the conditions of this stability test and may become incompatible with other refinery fuels, when admixed therewith.

The judicious selection of the operating conditions may result from a systematic experimentation of those skilled in the art. With this reserve, the temperature usually ranges from 420° to 490° C., preferably from 440° to 460° C., the pressure being from 40 to 200 bars and preferably from 70 to 110 bars, the residence time being from 10 seconds to 15 minutes, preferably from 5 to 10 minutes; the operation is preferably conducted with a residence time in the hydrovisbreaking furnace of from about 10 seconds to 1 minute, the reaction being optionally completed in a soaking chamber. The hydrogen amount is usefully from 200 to 3000 $Nm^3/m^3$ of liquid charge and, preferably, from 300 to 1000 $Nm^3/m^3$.

The distillation in step (b) of the process does not necessarily require a cut at the level of 375° C.; depending on the composition of the charge, the cut can be made at a higher and/or lower level, e.g at 350° C. or below, or up to 400° C. or above.

The accompanying drawing illustrates the process of the invention:

The hydrocarbon charge (1) with added hydrogen (2) passes through the hydrovisbreaking furnace and then, optionally, through the soaking chamber, this assembly being shown with reference (3). The effluent (4) is fractionated in the distillation column (5). At the top, through line (6) is separated a light fraction distilling below about 350° to 400° C.; from the bottom is recovered a heavy fraction which is supplied through line (7) to a settler-extractor (8) fed with recycle extraction solvent (line 12) and fresh solvent (line 16). The extract is supplied, through line (9), to a distillation system (10), where the solvent is separated from the residue and condensed (11), then recycled to the extractor (line 12). The deasphalted oil fraction (line 13) is admixed with the distillation light fraction (line 6) to form the easily transportable oil (line 14). The asphaltene fraction is recovered from line (15), then separated from the solvent contained therein in an evaporation system, not shown.

EXAMPLE 1 ILLUSTRATING THE PROCESS OF THE INVENTION

The treated charge is a desalted Boscan crude oil whose analysis is as follows:

| | |
|---|---|
| specific gravity $d_4^{15}$ = 0.998 | |
| viscosity at 100° C.: 280 cst (280 $mm^2/s$) | |
| API degree: 10.3 | |
| Sulfur content by weight: 5.3% | |
| Nitrogen content by weight: 5800 ppm | |
| Content by weight of metals (Ni + V): 1,350 ppm | |
| Asphaltenes content by weight (determined with n-heptane): 12.6% | |
| distillation (% by weight): | |
| $C_5$ - 200° C. = 3.75 | |
| 200–375° C. = 13.53 | 17.10 |
| (of which 200–350° C. = 11.25) | |
| 375° C.+ = 82.90 | |

This crude oil (100 parts by weight) is subjected to a hydrovisbreaking under the following conditions:

temperature: 440° to 460° C.

pressure: 100 bars volumic ratio of $H_2$ to the hydrocarbon charge: 500 $Nm^3/m^3$.

total residence time: 8 min including 1 min in the furnace and 7 min in the soaking chamber.

The hydrovisbreaking effluent is distilled and the following distillates, expressed in parts per 100 parts of crude oil, are recovered:

$H_2S+NH_3$=1.53 parts $C_1$–$C_4$=1.21 parts $C_5$-200° C.=8.40 parts

200°–375° C.=23.86 parts i.e., a total of 35.00 parts. It is thus apparent that the proportion of the 375° C.− fraction has been increased from 17.10 parts for the crude oil to 35 parts after the hydrovisbreaking treatment, corresponding to the formation of 17.90 parts from the 82.90 parts of the 375° C.+ fraction, which means a 21.6% conversion of the latter fraction.

The nickel and vanadium content of the distillate is zero.

the distillation residue, amounting to 65 parts by weight, has a viscosity of 230 cSt at 100° C.; when subjected to the stability test of standard ASTM D 1661, it complies with this standard conditions (result obtained: 1).

It is deasphalted with n-pentane used in a ratio by volume of pentane to the charge to be deasphalted of 3 to 1.18 parts by weight of asphalts (after evaporation of pentane) and 47 parts by weight of deasphalted oil are recovered, the latter being defined hereinafter by the distillation cuts:

375°–520° C. amounting to 27 parts by weight

520° C.+ amounting to 20 parts by weight i.e., a total of 47 parts having a content of metals (Ni+V) of 183 ppm by weight.

The deasphalted oil is admixed with the distillate thus giving an oil having the following characteristics:

specific gravity: 0.915 viscosity at 100° C.: 5.8 cSt (5.8 $mm^2/s$)

API grade: 23.1

Content by weight of metals (Ni+V)=105 ppm distillation (in parts per 100 parts of crude oil):

$H_2S+NH_3$=1.53 parts $C_1$–$C_4$=1.21 parts $C_5$-200° C.=8.40 parts

200°–375° C.=23.86 parts

375°–520° C.=27.00 parts

520° C.+=20.00 parts i.e., a total of 82 parts.

EXAMPLE 2 (COMPARATIVE)

By way of comparison, in order to show the advantage of maintaining a substantial proportion of the 200°–375° C. fraction in the hydrovisbreaking charge, the above example has been repeated with the crude oil (100 parts by weight) subjected to pre-distillation, so as to separate the $C_5$-375° C. fraction, amounting to 17.1 parts by weight. Only the 375° C.+ fraction (82.90 parts by weight) has been subjected to the operations described in example 1: hydrovisbreaking, distillation and deasphalting, the operating conditions remaining unchanged.

After admixture of the pre-distillate with the distillate (13.81 parts by weight) and the deasphalted oil (47.09 parts by weight, having a content of metals (Ni+V) of 282 ppm, 78 parts by weight of oil are obtained, said oil having the following characteristics:

specific gravity: $d_4^{15}$=0.940 viscosity at 100° C.=6 cSt (6 $mm^2/s$)

API grade=19

Content by weight of metals (Ni+V)=170 ppm.

distillation (in parts per 100 parts of crude oil):

$H_2S+NH_3$=1.17 parts $C_1$–$C_4$=0.94 parts $C_5$-200° C.=6.91 parts

200°–375° C.=21.89 parts

375°–520° C.=24.09 parts

520° C.+=23.00 parts i.e., a total of 78 parts.

The obtained results are clearly not so good (yield, proportion of 520° C.+ fraction, metals content) as when operating as in example 1 of the invention.

EXAMPLE 3 (COMPARATIVE EXAMPLE)

By way of comparison, in order to show the disadvantages of a more extended hydrovisbreaking, 100 parts by weight of the desalted Boscan crude oil of example 1 is subjected to a hydrovisbreaking to such an extent that the conversion rate of the 375° C.+ fraction to the 375° C.− fraction is higher than 30%; under these conditions the following fractions are obtained by distillation of the effluent:

| | |
|---|---|
| $H_2S + NH_3$ = | 1.70 parts |
| $C_1$–$C_4$ = | 2.10 parts |
| $C_5$ - 200° C. = | 12.50 parts |
| 200–375° C. = | 32.00 parts |
| Total = | 48.30 parts. |

i.e., a conversion rate of the 375° C.+ fraction to a 375° C.− fraction of 37.6%. But the increase of the yield of the 375° C.− fraction is detrimental to the yield of the 375° C.+ effluent, which has a viscosity of 5,000 cSt at 100° C. (to be compared with viscosities of 3,500 cSt at 100° C. of the same crude oil fraction and of 230 cSt at 100° C. of the same fraction as obtained according to exemple 1 of the invention).

In addition, this 375° C.+ fraction does not comply with the stability test ASTM D 1661 (the value found is 3).

EXAMPLE 4 (COMPARATIVE EXAMPLE)

The interest of the treatment diagram of example 1 according to the invention is also clear when comparing the results obtained in said example to those obtained by a mere deasphalting of the same crude oil. When 100 parts by weight of crude oil are deasphalted with n-pentane, used in a proportion by volume of solvent to the charge of 5, there are recovered, after separation of the asphaltenes and evaporation of pentane from the oil phase, 75 parts of deasphalted oil having the following characteristics:

specific gravity: 0.971; viscosity at 100° C.: 425 cSt (425 mm2/s)

Ni and V content: 550 ppm; °API: 14.2

It is thus apparent that this treatment leads to an oil of a too high viscosity for being easily transported and whose metals content is too high for making possible its direct use as charge in catalytic refining treatments.

What is claimed is:

1. A process for converting a highly viscous hydrocarbon charge to a less viscous, more easily transportable and more easily refinable hydrocarbon fraction, comprising the steps of:

(a) subjecting a hydrocarbon charge containing 10 to 30% by weight of constituents normally distilling below 375° C., including 8 to 25% by weight of constituents normally distilling between 200° C. and 350° C., the balance normally distilling above 375° C., to a hydrovisbreaking treatment under conditions wherein the conversion of the 375° C.+ fraction to a 375° C.− fraction is 10–30% by weight, said treatment being initially effected in a hydrovisbreaking furnace and completed in a soaking chamber;

(b) fractionating the effluent from step (a), and separately recovering an overhead fraction at least 90% of which normally boils below 375° C., and a distillation residue;

(c) deasphalting the distillation residue from step (b) with a $C_4$–$C_6$ hydrocarbon solvent, separately recovering an extract fraction and an asphaltenes fraction, fractionating the extract fraction, and separately recovering the deasphalting solvent and a deasphalted oil fraction; and (d) admixing at least a portion of the overhead fraction from step (b) with at least a portion of the deasphalted oil fraction from step (c) to form a hydrocarbon fraction which is less viscous, more easily transportable and more easily refinable than said hydrocarbon charge.

2. A process according to claim 1, wherein the hydrocarbon charge has a specific gravity ($d_4^{15}$) higher than 0.970, an asphaltenes content higher than 5% by weight, a content of metals (Ni+V) higher than 200 ppm by weight and a viscosity higher than 50 cSt at 100° C.

3. A process according to claim 1, wherein the hydrovisbreaking step (a) is effected at 420°–490° C., at a pressure of 40–200 bars, with a total residence time from 10 seconds to 15 minutes, and a hydrogen amount of from 200 to 300 $Nm^3/m^3$ of liquid charge.

4. A process according to claim 1, wherein the conversion of the 375° C.+ fraction to a 375° C.− fraction is from 15 to 25%.

5. A process according to claim 1, wherein in the hydrovisbreaking treatment of step (a), the residence time of the charge in the hydrovisbreaking furnace is from 10 seconds to 1 minute, the balance of the residence time being in the soaking chamber, and the total hydrovisbreaking residence time being from 10 seconds to 15 minutes.

6. A process according to claim 1, wherein in the deasphalting treatment of step (a), the hydrocarbon solvent comprises at least 90% of $C_5$–$C_6$ hydrocarbons.

7. A process according to claim 3, wherein said temperature is 440°–460° C., said pressure is 70–110 bars, and said total residence time is 5–10 minutes.

8. A process according to claim 7, wherein in the hydrovisbreaking treatment of step (a), the residence time in the hydrovisbreaking furnace is from 10 seconds to 1 minute, the balance of the residence time being in the soaking chamber.

9. A process according to claim 3, wherein said hydrogen amount is from 300 to 1000 $Nm^3/m^3$ of liquid charge.

* * * * *